United States Patent [19]

Leupold

[11] Patent Number: 5,014,028

[45] Date of Patent: May 7, 1991

[54] TRIANGULAR SECTION PERMANENT MAGNETIC STRUCTURE

[75] Inventor: Herbert A. Leupold, Eatontown, N.J.

[73] Assignee: The United States of America as represented by the Secretary of the Army, Washington, D.C.

[21] Appl. No.: 514,474

[22] Filed: Apr. 25, 1990

[51] Int. Cl.[5] ..... H01F 7/00

[52] U.S. Cl. ..... 335/210; 335/306; 315/3.5

[58] Field of Search ..... 335/210, 302, 306; 315/3.5

[56] References Cited

U.S. PATENT DOCUMENTS

| | | | |
|---|---|---|---|
| 2,799,813 | 7/1957 | Rademakens et al. | 335/210 |
| 3,168,686 | 2/1965 | King et al. | 335/306 |
| 3,205,415 | 9/1965 | Seki et al. | 335/210 |
| 3,768,054 | 10/1973 | Neugebauer | 335/306 X |
| 4,614,930 | 9/1986 | Hickey et al. | 335/306 X |

*Primary Examiner*—George Harris

*Attorney, Agent, or Firm*—Michael Zelenka

[57] ABSTRACT

The invention disclosed herein is a permanent magnet structure which is useful in focusing or guiding charged particle beams, such as those employed in traveling wave tubes, wigglers and undulators. The magnets are annular or planar in shape and have a cross-sectional configuration which is triangular in shape. The cross section forming the triangular magnet sections is that plane which contains the linear beam path and intersects the magnets. The magnetizations of the magnets are oriented perpendicular to the magnetizations of adjacent magnets such that no magnetic poles exist on the outer surface of the permanent magnetic structure.

10 Claims, 7 Drawing Sheets

(PRIOR ART) 670

TRIANGULAR SECTION PERMANENT MAGNETIC STRUCTURE

The invention described herein may be manufactured, used, and licensed by or for the Government of the United States for governmental purposes without the payment to me of any royalties thereon.

FIELD OF THE INVENTION

The present invention relates generally to the technology of permanent magnet structures, particularly to the arrangement of permanent magnets useful in the manipulation of charged particle beams, and more particularly, to the use of permanent magnets in the construction of apparatus for focusing or accelerating charged particle beams and for the precise control and leakage free containment thereof, such as found in traveling wave tubes (TWT).

BACKGROUND OF THE INVENTION

The utilization of permanent magnet structures for the manipulation of charged particle beams has been widely accepted in the electronics industry. To achieve the proper operation of charged particle beam devices it is useful to apply a magnetic field having its magnetic flux parallel, or anti-parallel, to the longitudinal axis of the path of travel of the charged particle beam. Such a magnetic field may be used to either focus or guide the charged particle beam along its projected axis. In devices such as traveling wave tubes, the permanent magnet structure is employed around the space through which the charged particle beam is projected to focus the beam. The efficacy of traveling wave tubes depends to a great extent upon the strength of the axial magnetic fields used to prevent divergence of the dense charged particle beam that amplifies the microwave signal.

In conventional traveling wave tubes, the magnetic field source consists of a stack of annular axially oriented magnets of alternating polarity, interspersed with iron rings or pole pieces that facilitate the induction of the magnetic flux into the working space of the permanent magnet structure. The permanent magnets are aligned axially about the path of the charged particle beam and often arranged in a sequence of alternating magnetizations, either parallel to, or anti-parallel to, the direction of the electron flow. Such a permanent magnet structure produces an axial magnetic field that alternate with progression along the axis. Usually, the pole pieces are indented at the outer surface of the structure to reduce the magnetic flux leakage to the exterior of the structure. Indentation of the pole pieces is only one of several schemes that can be used to increase the proportion of flux entering the working space. See U.S. Pat. No. 4,731,598 issued to Clarke, Mar. 15, 1989 (hereinafter Clarke). However, all resulting arrays of permanent magnet structures which use pole pieces are limited by the saturability of the pole pieces, the formation of detrimental magnetic poles on the outer radius of the pole pieces and the additional space the interstitial pole pieces occupy. The saturability of the pole pieces inhibits their capability as flux conductors which represents an inefficient use of material. The formation of magnetic poles on the outer radius of the pole pieces which oppose the magnetic poles of the inner surface of the magnet structure reduces the useful magnetic field directed toward the working space.

With the advent of magnetically rigid, high energy-product materials such as the rare earth permanent magnets, it became practical to design permanent magnet structures that have no pole pieces but that have magnetic pole sources closer to the working space and thus, remedying some of the negative effects, such as increased mass, experienced with pole piece designs. One permanent magnet structure design that has been cited to accomplish this is U.S. Pat. No. 4,829,276 issued to Leupold et al, May 9, 1989 (hereinafter Leupold) wherein a magnet structure of radially magnetized toroidal magnets with alternating polarities was disclosed. This design, however, forms magnetic poles on the outer surface of the magnet structure which, like the interstitial pole piece design, reduce the useful magnetic field directed toward the working space. Optimally, this hybrid structure would best reduce the mass of the structure while maintaining magnetic field strength, if there were a gradual clockwise variation of magnetic orientation. However, such a structure is not technologically practicable.

Permanent magnet structures are also required as components of devices that produce electromagnetic radiation by free electron laser action. When employed in such devices the permanent magnet structure is referred as a "wiggler" or "undulator". Generally, the magnets are arranged in a linear sequence with alternating interstitial pole pieces such that their magnetizations are perpendicular to the axis of the beam path. This magnetic field causes the charged particles to accelerate thereby producing electromagnetic radiation.

As cited previously, one problem that develops by the use of permanent magnet structure designs is the leakage of magnetic flux to the exterior of the structure. The leakage of magnetic flux complicates the addition of other components near the permanent magnet structure, disrupts the function of the entire beam focusing device and otherwise represents inefficient use of magnetic materials. Another problem that arises is the reduction of the useful magnetic field in the working space of the structure due to the opposing poles formed on the outer surface of the structure. This reduction of the useful magnetic field within the structure also represents inefficient use of magnetic materials as well as reduces the usefulness of the structure. A critical objective, then, of those who develop magnetic structures used to manipulate charged particle beams has been to efficiently use the magnetic materials which make up the structure as well as arrange the magnetic materials in order to reduce or eliminate the leakage of magnetic flux to the outside of the structure. Another objective is to increase the field gradients within the working space without increasing the size or weight of the structure. The present invention addresses these objectives.

SUMMARY OF THE INVENTION

One objective of this invention is to maintain the amount of useful magnetic flux along a path of a charged particle beam while eliminating the leakage of magnetic flux outside of the structure.

Another objective of the present invention is to increase the efficiency of a magnetic structure used to focus or accelerate a beam of charged particles.

Another object is to maintain the magnetic field and its strength along the path of a charged particle beam while decreasing the weight of the structure.

Another object is to increase the magnetic field strength within the working space of the permanent magnet structure.

These objects are achieved by the present invention which comprises an arrangement of permanent magnets useful in focusing or guiding a beam of charged particles. The beam of charged particles is directed through the working space of the structure, the region through which magnetic flux is preferentially directed. The cross-sectional configuration of the magnets is triangular in shape and each magnet forms a complementary triangle to an adjacent magnet so as to create a linear sequence with respect to said cross-section. The magnetization of the magnets is oriented in a direction perpendicular to the magnetizations of adjacent magnets. This configuration of triangular magnets with perpendicular magnetizations virtually eliminates the leakage of the magnetic flux to the exterior of the structure as well as increases the useful magnetic flux within the structure.

This is accomplished due to the lack of any magnetic poles on the outer surface of the permanent magnet structure. The axial magnets which form the outer surface of the permanent magnet structure create no magnetic poles on the outer surface of the permanent magnet because their magnetizations are oriented parallel to the outer surface. The inner surface of the permanent magnet structure, however, is completely comprised of the bases of the radial magnets, those which have magnetizations perpendicular to the axis. Therefore, the only magnetic surface poles of the permanent magnet structure are on the inner surface of the magnet structure. Because of the forty five degree base angles of the magnet sections, the radial magnets induce magnetic poles at the triangular boundaries that are equal and opposite to those produced by the axial magnets. Therefore, the magnetic poles at the boundaries between adjacent magnets are canceled. This configuration increases the magnetic field in the working space as compared to the conventional magnet structures because there are no net magnetic poles on the outer surface of the structure. The present invention, therefore, reduces the size of the tube needed for a conventional traveling wave tube, while maintaining the same magnetic field strength. In this way, weight and size reduction of one or two orders of magnitude are attainable depending on the device.

BRIEF DESCRIPTION OF THE DRAWINGS

These and other objects, features, and details of the invention will become apparent in light of the ensuing detailed disclosure, particularly in light of the drawings wherein.

DETAILED DESCRIPTION

Figure 1:
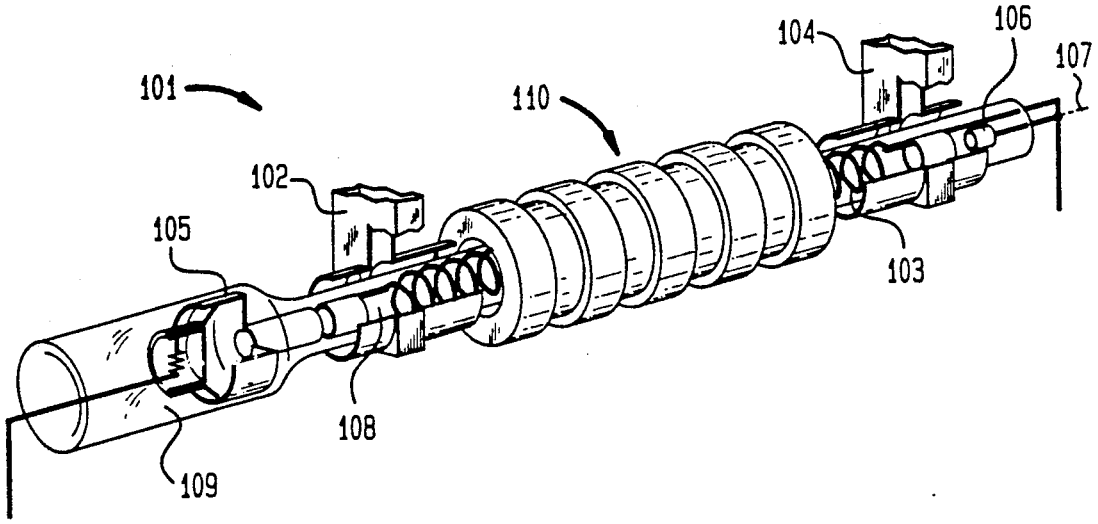
FIG. 1 (PRIOR ART)
FIG. 1 is a perspective view of a conventional traveling wave tube.

FIG. 1 is an idealized view of a conventional traveling wave tube (TWT). The major components of the TWT 101 are contained within a tube body 109. A permanent magnet structure 110 is oriented along an axis 107 of the tube body 109. A microwave signal is directed along the axis 107 beginning at a point 102 and ending at end point 104. This signal travels through the helical structure 103, which is wrapped around the axis 107 of the tube body 109. A charged particle beam is created by an electron gun 105, projected down the axis 107 of the tube body 109, and absorbed at a collector 106. The charged particle beam is focused by the permanent magnet structure 110 which surrounds the charged particle beam 108 and the helical structure 103. The interaction between the charged particle beam and the microwave signal produces the desired amplification of the microwave signal.

Figure 2:
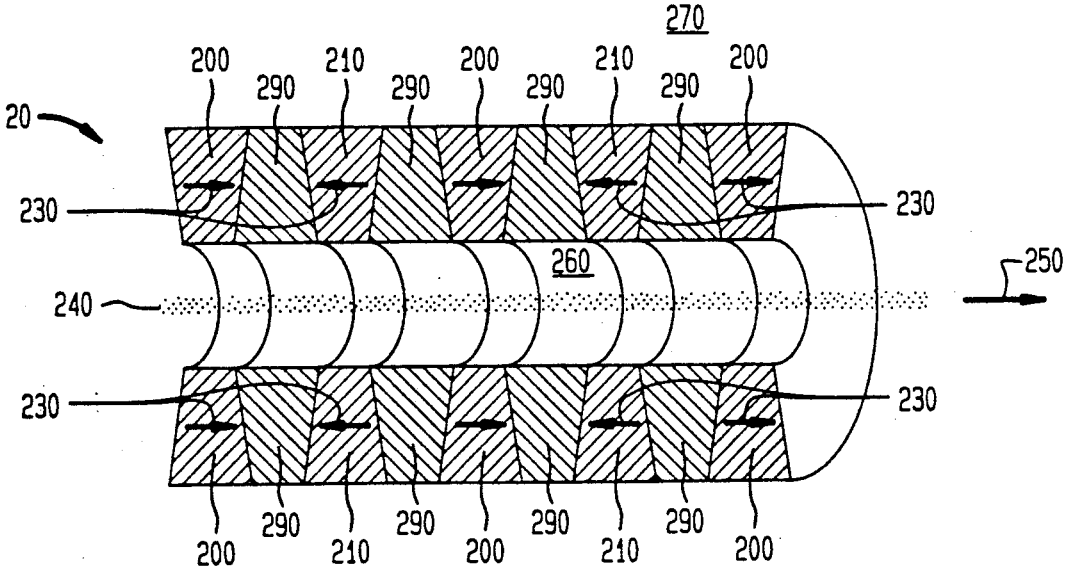
FIG. 2 (PRIOR ART)
FIG. 2 is a perspective view of a longitudinal cross-section of a permanent magnet structure as revealed by Clarke.

FIG. 2 illustrates a longitudinal cross-section of the Clarke permanent magnet structure. The charged particle beam 240 travels generally along a path down the axis of the evacuated cylindrical space 260 in the direction indicated by the arrow 250. The magnetic flux needed to focus the charged particle beam is provided by the toroidal permanent magnets 200 and 210 which are arranged coaxial to the charged particle beam 240 in a linear sequence with the magnetization vectors 230 oriented in the alternating pattern shown. In between each of the successive magnet is a toroidal pole piece 290 comprised of ferromagnetic material. The magnetic flux travels from areas of higher magnetic potential to areas of lower magnetic potential. The flux that travels outside the device represents a waste of the total flux generated by the permanent magnets 200 and 210. The function of each device would be enhanced if this magnetic flux leakage could be reduced or eliminated.

Figure 3:
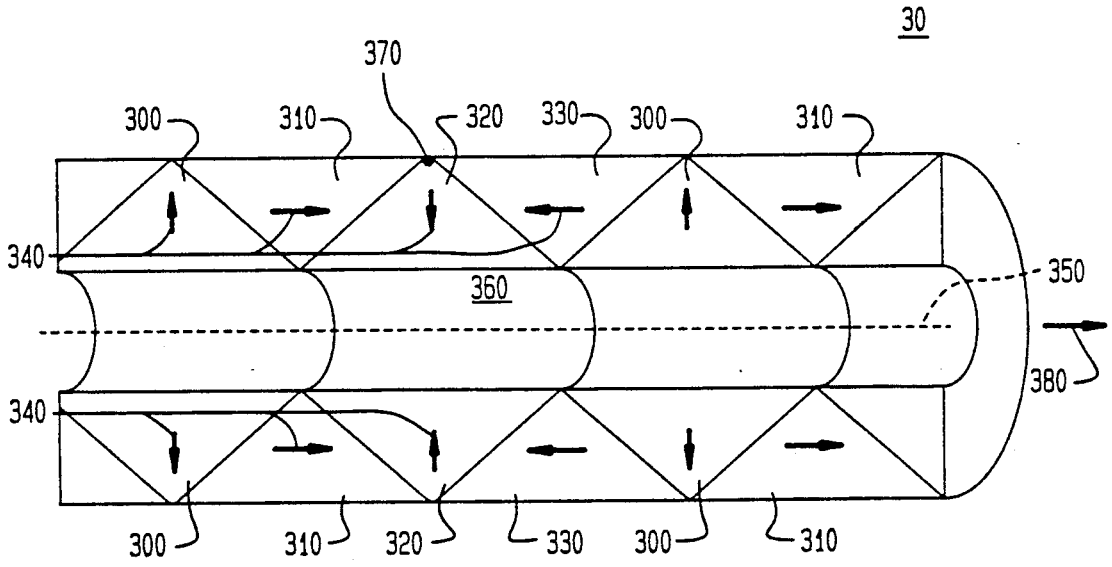
FIG. 3 is a perspective view of the longitudinal cross-section of the permanent magnet structure in accordance with the present invention.

FIG. 3 illustrates a longitudinal cross-section of a permanent magnet structure 30 which employs the present invention. The magnets 300, 310, 320 and 330 are annular in shape and are substantially similar in triangular symmetry with respect to a plane that intersects the axis 350 longitudinally. Each of the magnets 300, 310, 320, and 330 are arranged coaxial to the axis 350 in linear sequence forming complementary angles to each other.

The magnetization vectors 340 of the magnets 300, 310, 320, and 330 are oriented in the pattern as shown and preferentially rotate ninety degrees or $\pi/2$ radians in a uniform direction that progresses longitudinally along the axis 350. The axial magnets 310 and 330 have no magnetic poles at their bases due to the parallel orientation of their magnetizations to their base. Because the entire outer surface 370 is comprised of the bases of the axial magnets 310 and 330 no magnetic poles exist on the outer surface 370. The inner surface of the permanent magnet structure 30 is completely comprised of the bases of the radial magnets 300 and 320, those which have magnetizations perpendicular to axis 350. Therefore, the only magnetic surface poles of the permanent magnet structure 30 are on the inner surface of the permanent magnet structure 30. Although axial magnets 310 and 330 are optimally triangular in shape, axial magnets 310 and 330 may be trapezoidal in shape if a desired magnetic field necessitates the separation of the surface poles produced by radial magnets 300 and 320.

The base angles of the magnets 300, 310, 320, and 330 are preferentially forty five degrees. With this geometrical configuration, the radial magnets 300 and 320 induce magnetic poles at the triangular boundaries that are equal and opposite to those produced by the axial magnets 310 and 330. Therefore, the magnetic poles at the triangular boundaries between adjacent magnets are canceled. A decrease of the base angle would cause the formation of net detrimental magnetic poles along the triangular boundaries and thus, reduce the magnetic field directed toward the working space 360. If the base angle is increased, favorable poles are formed at the boundaries, but the mass of the structure increases rapidly with an increase in desired magnetic field strength.

Figure 4:
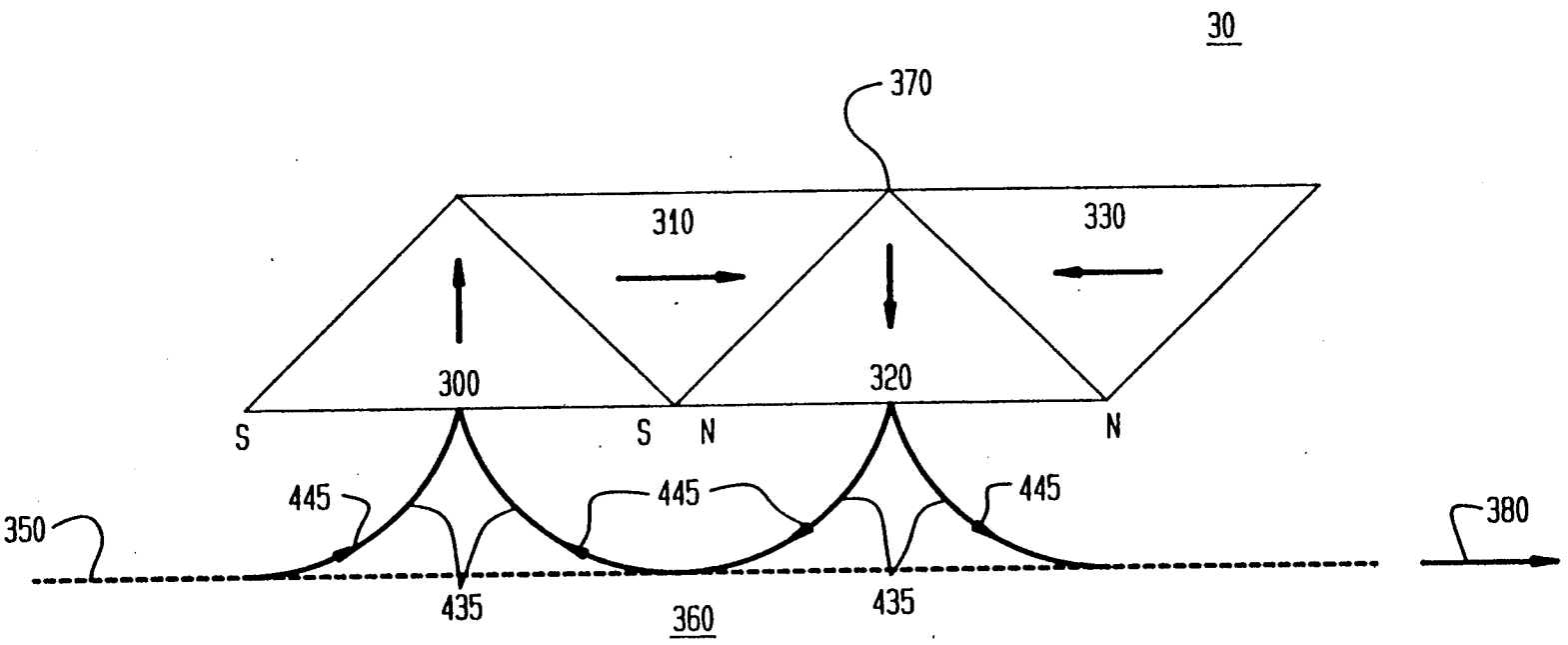
FIG. 4 is a cross sectional view of one element of the permanent magnet structure in accordance with the present invention.

FIG. 4 shows the lines of magnetic induction created by the present invention as indicated by the curves 435 and the arrows 445 show the direction of the magnetic field at various points. As shown, no magnetic poles exist on the outer surface; thus, there are no opposing magnetic poles on the outer surface 370 which would otherwise reduce the useful magnetic field directed toward the working space 360. Thus, the present invention provides an increased magnetic field strength within working space 360. Further, the magnetic field gradients produced by the present invention are greatly increased within working space 360 as compared to other permanent magnet structures.

Figure 5A:
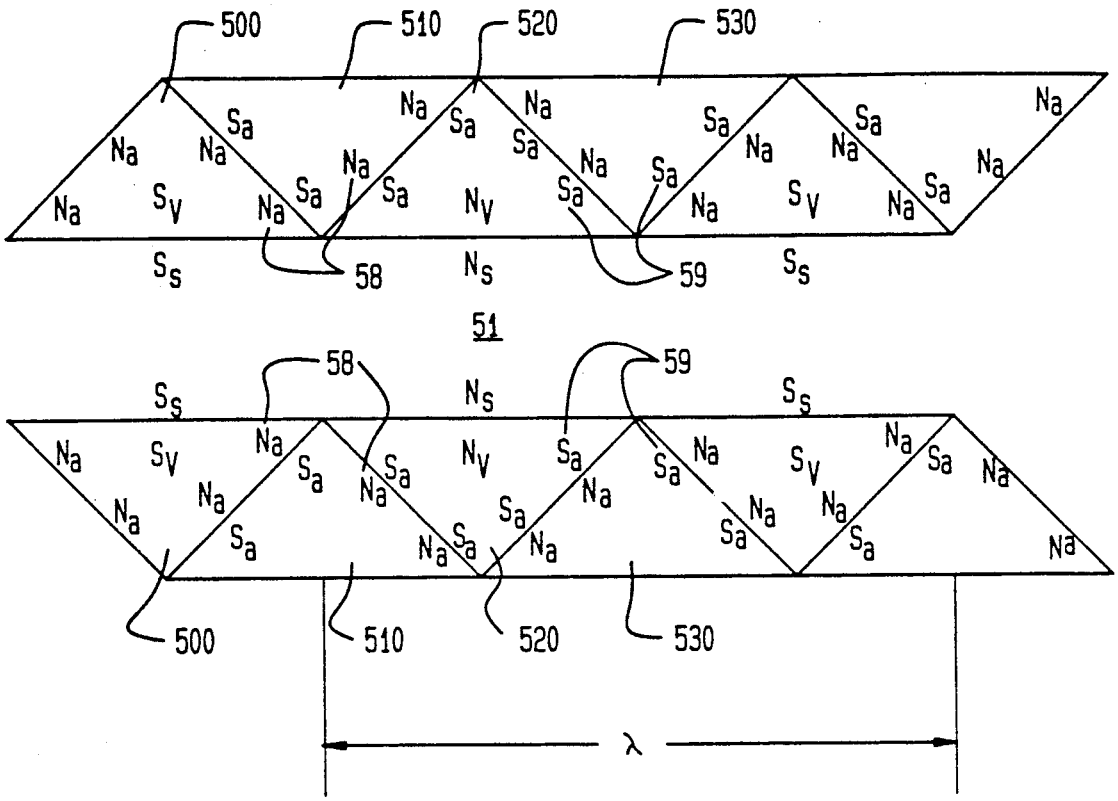
FIG. 5*a* is a schematic representation of a portion of FIG. 3.
Figure 5B:
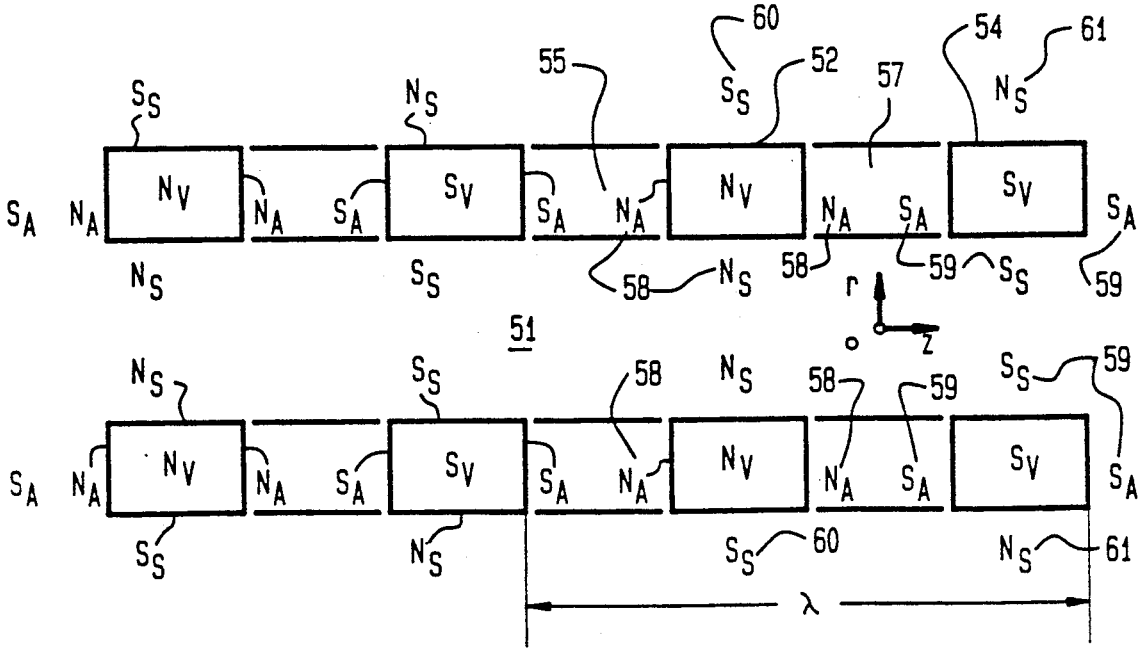
FIG. 5B (PRIOR ART)
FIG. 5*b* is a schematic representation of a portion of a cross-sectional view of the permanent magnet structure as revealed by Leupold.

FIGS. 5*a* and 5*b* are schematic representations of the present invention and that of Leupold, respectively. Both figures illustrate the volume (Nv and Sv) and surface poles (Ns, Ss, Na, and Sa) of the toroidally shaped magnets of both inventions. The radial magnets of FIG. 3 are represented by magnets 500 and 520; the axial magnets of FIG. 3 are represented by magnets 510 and 530. The surface poles Ns and Ss are formed solely by the radial magnets 500 and 520. As shown, the surface poles at the triangular boundaries 58 and 59 are equal and opposite in magnitude thus, canceling each other. Therefore, the surface poles 58 and 59 at the triangular boundaries have no effect on the magnetic field directed toward the working space 51.

In comparison, Leupold teaches that the north surface poles 58 and south surface poles 59 of FIG. 5*b* establish a magnetic field that induces the pole at point o to move to the right. However, this beneficial effect is counteracted by the north poles 61 and the south poles 60 which establish a counter magnetic force at point o and which tend to move the pole at point o to the left. As a consequence, there is a reduction of the useful magnetic field that may otherwise be useful in the manipulation of the charged particle beam.

Figure 6:
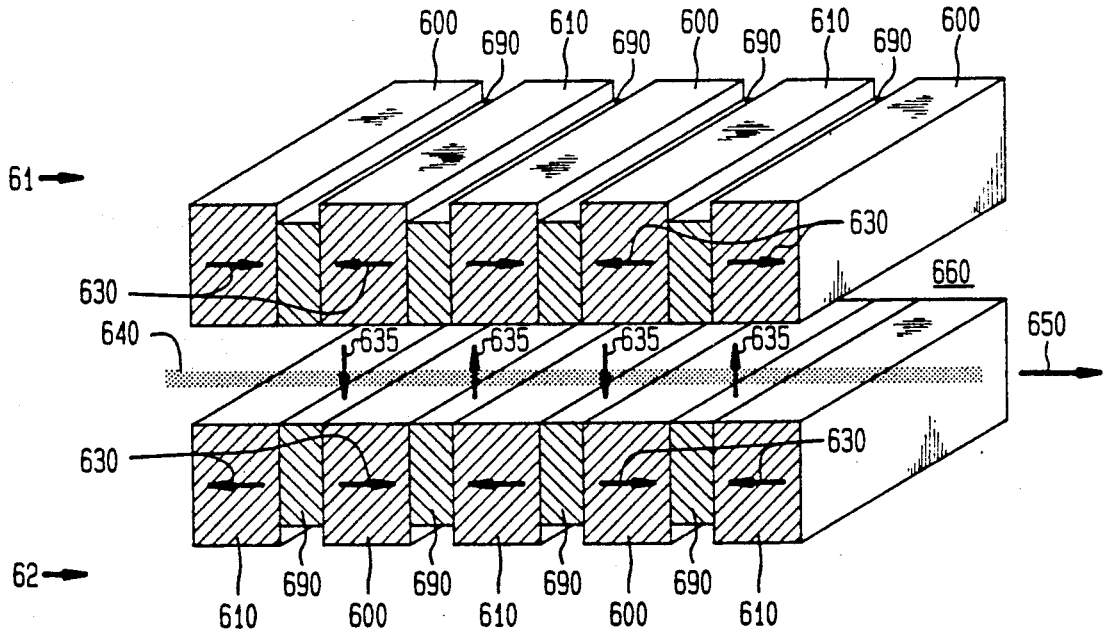
FIG. 6 is a perspective view of a conventional wiggler.

FIG. 6 illustrates a conventional wiggler. Two separate planar arrays 61 and 62 of magnets 600 and 610 and interstitial pole pieces 690 form the space 660 through which the charged particle is projected along an axis 650. Both planar arrays of magnets are a series of bar magnets 600 and 610 which alternate with the interstitial pole pieces 690. The upper and lower linear magnetic arrays 61 and 62 are constructed such that the magnets 600 and 610 and interstitial pole pieces 690 are aligned as shown. The magnets 600 and 610 are magnetized such that the magnetic dipole moments are either parallel or anti-parallel to the axis 650. The magnets 600 and 610 in each array are alternately oriented so that the direction of the magnetic fields alternate as indicated by the arrows 635 shown for each magnet 600 and 610. Generally, the interstitial pole pieces 690 are recessed slightly from the exterior region to reduce the flux loss to the exterior of the structure 670.

The magnetic field directed into the working space 650 is shown by the arrows 635 as indicated. These magnetic fields alternate periodically which causes the charged particle beam to accelerate. The acceleration of the charged particle beam generates electromagnetic radiation in the direction of the arrow 650.

Figure 7:
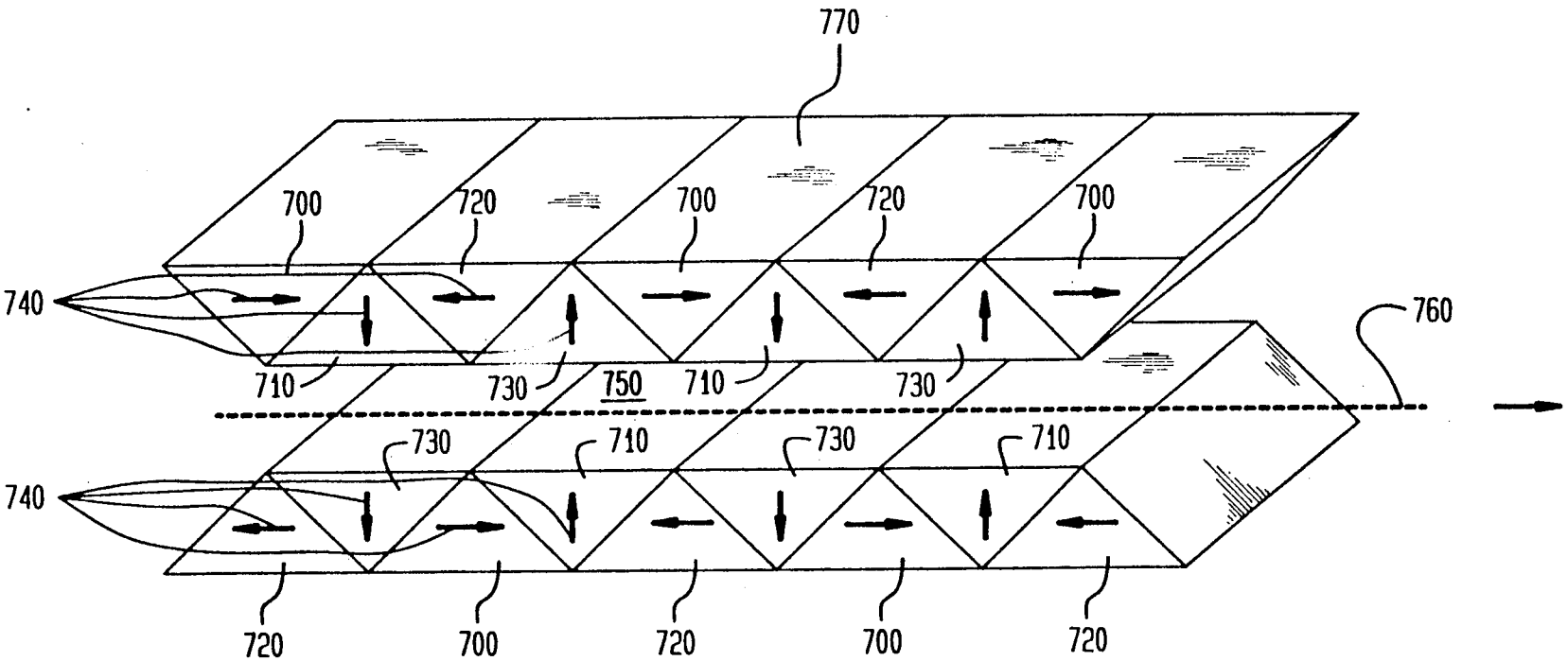
FIG. 7 is a schematic view of the permanent magnet structure employing the present invention.

FIG. 7 illustrates the present invention being employed as a wiggler. The magnets 700, 710, 720 and 730 form the two planar arrays of magnets which are placed equidistantly from the axis 760 of the projected charged particle beam. The magnet 710 and 730 taper toward the outer surface 770 and have their magnetizations, shown as arrows 740, oriented perpendicularly to the axis 760 in a direction opposite each other. The magnets 700 and 720 taper toward the working space 750 and have magnetizations, shown as arrows 740, oriented parallel to the axis 760 in directions opposite each other. Magnet 710 from the upper planar array is aligned with magnet 730 of the lower planar array such that the magnetic field is perpendicular to the axis 760 and crosses the axis 760. Magnet 730 from the upper array is aligned with magnet 710 of the lower array such that the magnetic field in working space 750 is oriented in the same direction to magnetization of magnet 710 of the upper array and magnet 730 of the lower array. As with the present invention employed in a traveling wave tube, magnets 700 and 720 can be trapezoidal in shape if a desired magnetic field necessitates the separation of the magnetic surface poles produced by magnets 710 and 730.

Figure 8:
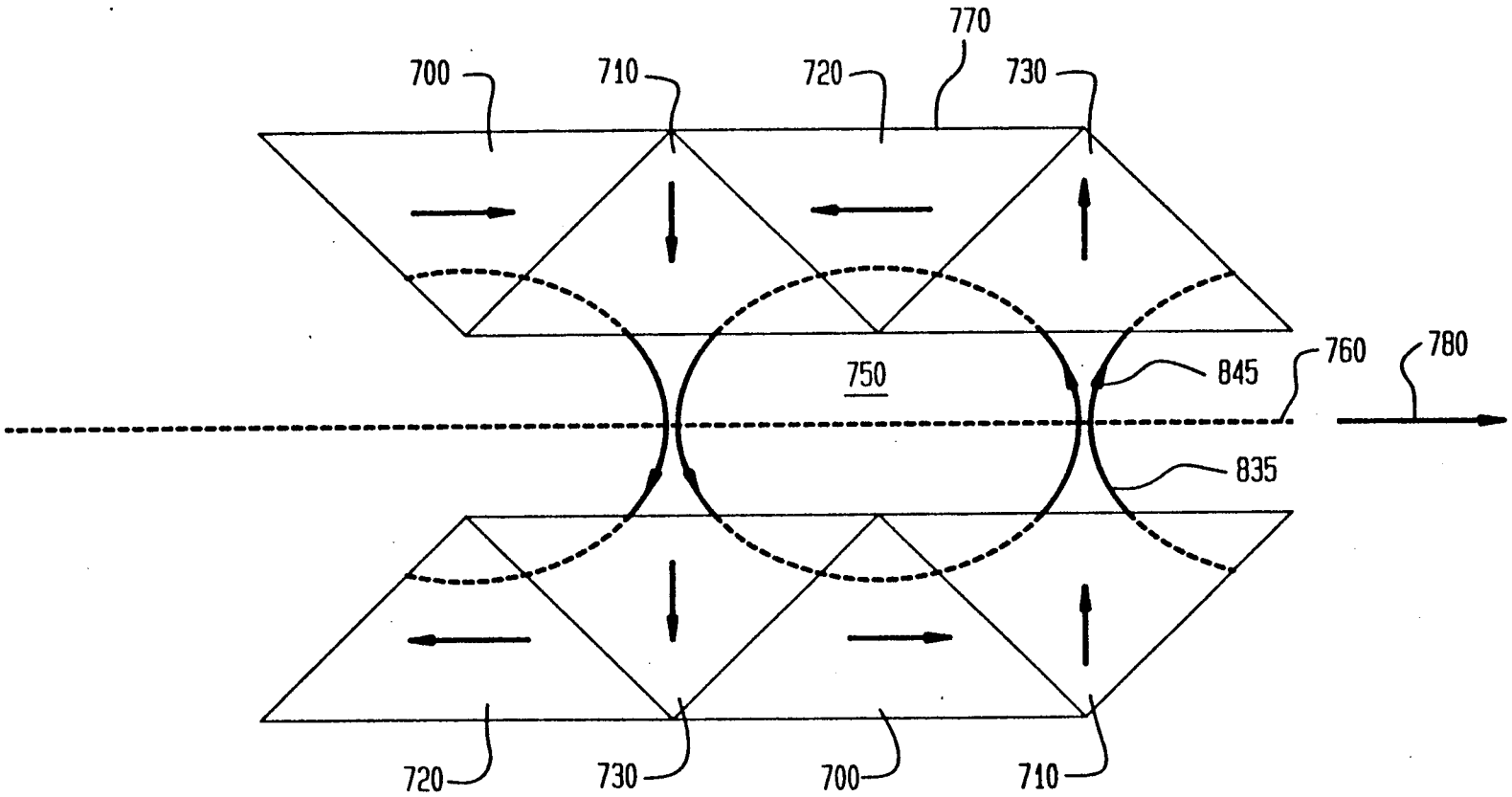
FIG. 8 is a cross sectional view of one element of the permanent magnet structure in accordance with the present invention.

FIG. 8 shows the lines of magnetic induction created by the present invention employed as a wiggler. The magnetic induction is indicated by the curves 835 and the arrows 845 show the direction of the magnetic field at various points. As shown, the magnetic field alternates across the axis 760 which causes the charged particle beam to accelerate, thereby generating electromagnetic radiation in the direction of arrow 780.

The exact dimensions and configurations of the permanent magnet structure and the magnetic flux potentials are all considered to be within the knowledge of persons conversant with this art. It is therefore considered that the foregoing disclosure relates to a general illustration of the invention and should not be construed in any limiting sense, it being the intent to define the invention by the appended claims.

What is claimed is:

1. A permanent magnet structure for focusing charged particle beams disposed along an axis, said permanent magnet structure comprising:

a series of magnets, said series forming a hollow cylinder which has an outer and inner portion and which is longitudinally aligned along said axis, each magnet being annular in shape where the cross-sectional configuration of said magnet is triangular, each magnet having a base and being aligned so as to complement an adjacent magnet and form said inner and outer portions of said cylinder, and each magnet having a magnetization which is oriented in a direction perpendicular to adjacent magnets wherein the magnetic orientation of said magnets rotates continually in one direction in increments of $\pi/2$ radians from end of the permanent magnet structure to the other and wherein the magnets forming the inner portion of said cylinder have a magnetization perpendicular to said axis and the magnets forming the outer portion of said cylinder have a magnetization parallel to said axis.

2. The magnet structure of claim 1 wherein adjacently disposed magnets are configured to have interfacing boundaries therebetween, said boundaries being oriented such that the vector components of magnetization of said magnets normal to said boundaries are opposite in magnitude.

3. The magnet structure of claim 2 wherein the base angles of the triangular magnets is forty to sixty degrees.

4. The magnet structure of claim 3 wherein said magnets are are selected from a group of magnetically rigid materials.

5. A permanent magnet structure for focusing charged particle beams disposed along an axis, said permanent magnet structure comprising:

a set of annular magnets, each magnet being substantially similar in triangular shape with respect to the longitudinal cross section of said permanent magnet structure and being aligned so as to complement adjacent magnets and form a hollow cylinder with inner and outer portions, the set of magnets having at least one pair of radial magnets which form the inner portion of the cylinder and at least one pair of axial magnets which form the outer portion of the cylinder, the pair of radial magnets having their magnetizations oriented perpendicular to said axis and in opposite directions to one another, the pair of axial magnets having their magnetizations oriented parallel to said axis and in a direction opposite one another.

6. A permanent magnet structure for accelerating charged particle beams disposed along an axis, said permanent magnet structure comprising:

a set of bar magnets disposed about said axis, said bar magnets being aligned in a plane which has an outer and inner portion and where the cross-sectional configuration of each magnet is triangular, each magnet having a base and being aligned so as to complement an adjacent magnet and form said inner and outer portions of said plane, and each magnet having a magnetization which is oriented in a direction perpendicular to adjacent magnets wherein the magnetic orientation of said magnets rotates continually in one direction in increments of $\pi/2$ radians from end of the permanent magnet structure to the other and wherein the magnets forming the inner portion of said plane have a magnetization perpendicular to said axis and the magnets forming the outer portion of said plane have a magnetization parallel to said axis.

7. The permanent magnet structure of claim 6 wherein adjacently disposed magnets are configured to have interfacing boundaries therebetween, said boundaries being oriented such that the vector components of magnetization of said bar magnets normal to said boundaries are opposite in magnitude.

8. The permanent magnet structure of claim 7 wherein two sets of bar magnets are disposed equidistantly along said axis and aligned such that the magnetic flux of the magnets cross said axis.

9. The permanent magnet structure of claim 7 wherein the base angles of the triangular magnets is forty to sixty degrees.

10. The permanent magnet structure of claim 8 wherein said bar magnets are selected from a group of magnetically rigid materials.

* * * * *